US007594501B2

(12) United States Patent
Brand et al.

(10) Patent No.: US 7,594,501 B2
(45) Date of Patent: Sep. 29, 2009

(54) CYLINDER HEAD COVER FOR AN INTERNAL COMBUSTION ENGINE

(75) Inventors: Manfred Brand, Elmenhorst (DE); Artur Knaus, Hamburg (DE); Mathias Reibe, Wittenberg (DE)

(73) Assignee: Dichtungstechnik G. Bruss GmbH & Co., KG, Hoisdorf (DE)

( * ) Notice: Subject to any disclaimer, the term of this patent is extended or adjusted under 35 U.S.C. 154(b) by 61 days.

(21) Appl. No.: 11/987,519

(22) Filed: Nov. 30, 2007

(65) Prior Publication Data

US 2008/0149065 A1 Jun. 26, 2008

(30) Foreign Application Priority Data

Dec. 22, 2006 (DE) ..... 10 2006 062 657

(51) Int. Cl.
*F01M 13/04* (2006.01)
*F02F 7/00* (2006.01)

(52) U.S. Cl. ..... 123/572

(58) Field of Classification Search ..... 123/572–574, 123/41.86

See application file for complete search history.

(56) References Cited

U.S. PATENT DOCUMENTS

| | | | | |
|---|---|---|---|---|
| 5,944,001 | A * | 8/1999 | Hutchins | 123/572 |
| 6,811,586 | B2 * | 11/2004 | Stegmaier et al. | 55/337 |
| 2003/0024512 | A1 * | 2/2003 | Kitano et al. | 123/572 |
| 2006/0112941 | A1 * | 6/2006 | Hilpert et al. | 123/573 |

FOREIGN PATENT DOCUMENTS

| | | | |
|---|---|---|---|
| DE | 19813702 | C1 | 8/1999 |
| DE | 200300596 | U1 | 7/2004 |
| DE | 102004002310 | A1 | 8/2005 |
| DE | 102004006082 | A1 | 8/2005 |
| DE | 102004016742 | B3 | 9/2005 |
| DE | 102004019154 | A1 | 11/2005 |
| DE | 102004033677 | A1 | 2/2006 |
| DE | 102004061938 | B3 | 6/2006 |
| DE | 10 2006 038 700 | A1 | 2/2008 |
| EP | 1614871 | A2 | 1/2006 |
| JP | 2003120250 | A | 4/2003 |
| JP | 2005155423 | A | 6/2005 |
| WO | WO-9620334 | | 7/1996 |

OTHER PUBLICATIONS

German Search Report dated Aug. 29, 2007 issued in German Counterpart Application No. 10 2006 062 657.5.

German Patent and Trademark Office Action, dated Oct. 28, 2008, issued in connection with German counterpart Application No. 10 2007 046 235.4-13 (w/English translation).

* cited by examiner

*Primary Examiner*—M. McMahon
(74) *Attorney, Agent, or Firm*—McCracken & Frank LLP

(57) ABSTRACT

A cylinder head cover for an internal combustion engine includes an oil separator with a vortex chamber extending in a longitudinal direction from a proximal end to a distal end. Said vortex chamber comprises an essentially pipe-shaped wall extending in said longitudinal direction, a gas inlet arranged at said proximal end of said vortex chamber and oriented tangentially to said essentially pipe-shaped wall, for tangentially blowing blow-by gas into said vortex chamber, such that a gas vortex flow helically rotating along said essentially pipe-shaped wall in the longitudinal direction from said proximal end to said distal end of said vortex chamber is created, and a gas outlet opening. The gas outlet opening is arranged in the region of said distal end of said vortex chamber.

9 Claims, 6 Drawing Sheets

CYLINDER HEAD COVER FOR AN INTERNAL COMBUSTION ENGINE

CROSS-REFERENCE TO RELATED APPLICATION

This application claims the priority of German Patent Application No. 10 2006 062 657.5, filed on Dec. 22, 2006, the subject matter of which is incorporated herein by reference. Each U.S. and foreign patent and patent application mentioned below is incorporated herein by reference.

FIELD OF THE INVENTION

The invention relates to a cylinder head cover for an internal combustion engine comprising an oil separator.

BACKGROUND OF THE INVENTION

Known cyclone separators, see documents DE 10 2004 033 677 A1, DE 203 00 596 U1, DE 10 2004 002 310 A1, DE 10 2004 019 154 A1, EP 1 614 871 A2, DE 10 2004 006 082 A1, JP 2005 155 423 A, comprise an essentially cylindrical vortex chamber with a tangential gas inlet. The helical gas vortex runs out in a cone wall and by means of an immersion tube provided in the region of the gas inlet, is extracted in the opposite direction through the interior of the gas vortex, such that a flow reversal of the gas occurs. Separated particles exit through an aperture for example in the tip of the cone wall. The manufacture of cyclone separators with closed chamber requires very elaborate injection moulds and is extremely difficult, which is why it was suggested with DE 10 2004 019 154 A1 to construct such cyclones from two parts to be manufactured with simple moulds.

Document DE 10 2004 016 742 B3 discloses an oil separator with a reed valve on the inlet side and a diffuser arranged downstream. Because of inertia owing to the sharp deflection of the gas, oil particles are separated on the wall surrounding the tip of the reed.

SUMMARY OF THE INVENTION

It is an object of the invention to provide a cylinder head cover with an oil separator having a simple construction and significantly reduced manufacturing effort.

The above and other objects are accomplished by the invention, wherein there is provided, according to one embodiment, a cylinder head cover for an internal combustion engine, comprising an oil separator with a vortex chamber extending in a longitudinal direction from a proximal end to a distal end, said vortex chamber comprising: an essentially pipe-shaped wall extending in said longitudinal direction, a gas inlet arranged at said proximal end of said vortex chamber and oriented tangentially to said essentially pipe-shaped wall, for tangentially blowing blow-by gas into said vortex chamber, such that a gas vortex flow helically rotating along said essentially pipe-shaped wall in the longitudinal direction from said proximal end to said distal end of said vortex chamber is created, and a gas outlet opening, wherein said gas outlet opening is arranged in the region of said distal end of said vortex chamber.

According to another embodiment, there is provided a cylinder head cover for an internal combustion engine, comprising an oil separator with a vortex chamber extending in a longitudinal direction from a proximal end to a distal end, said vortex chamber comprising: a plurality of parallel sub-chambers each comprising an essentially pipe-shaped wall extending in said longitudinal direction, a gas inlet common to said sub-chambers arranged at said proximal end of said vortex chamber and oriented tangentially to each of said essentially pipe-shaped walls, for tangentially blowing blow-by gas into said sub-chambers, such that a gas vortex flow helically rotating along said essentially pipe-shaped wall in the longitudinal direction from said proximal end to said distal end of said vortex chamber is created in each of said sub-chambers, and at least one gas outlet opening, wherein said gas outlet opening is arranged in the region of said distal end of said vortex chamber.

Through the arrangement of the gas outlet opening in the region of the distal end of the vortex chamber the immersion tube provided in the prior art becomes dispensable which results in a simplified construction. In addition, during the manufacture of the oil separator preferably manufactured of a plastic, an injection mould can engage in the vortex chamber through the gas outlet opening, which substantially reduces the effort for the mould. It has shown that the arrangement of the gas outlet opening at the run-out end of the vortex chamber does not lead to a picking-up of separated oil droplets through the gas flow which would adversely affect the function of the separator. The distal end of the vortex chamber may be defined as an end of the vortex chamber where the vortex flow runs out and turns from the helical flow to an essentially non-helical flow after having passed through said vortex chamber. Therefore, the distal end of the vortex chamber may also be designated as a run-out end.

Owing to the tangential gas inlet a rotating, helical gas vortex is induced in the pipe-shaped vortex chamber which extends from the gas inlet to the distal end of the vortex chamber. For this purpose the vortex chamber is expediently shaped substantially cylindrically or pipe-shaped, wherein this term means a shape which is rounded in cross section, for example oval or round, and encompasses a cross section which changes over the length of the vortex chamber. The helical gas vortex is created without helical or coil-shaped facilities such as for example helical surfaces or helical channels. In other words, the vortex chamber is free of helical or coil-shaped guiding devices. This delimits the invention over helix-shaped oil separators.

Preferably the gas inlet is designed open, i.e. valve-free. Through this, the invention can for example be delimited over oil separators with a reed valve at the gas inlet. The open gas inlet allows an effective separating effect even with low flow rates at which a reed valve would not yet open. For the same reason it is further advantageous if the entire oil separator including gas inlet and gas outlet is designed valve-free.

In order to counteract picking-up of separated oil droplets by the gas flow the vortex chamber preferably widens towards the gas outlet side in the manner of a diffuser through which the gas velocity is reduced in this region and the gas vortex separates from the chamber wall so that the draining liquid loses the gas contact and is not again dragged along by the gas flow.

In a further embodiment the vortex chamber has two sub-chambers arranged symmetrically to the gas inlet for the formation of two counter-rotating gas vortices. In comparison with a separator with only one gas vortex the flow rate of the separator can be substantially increased with moderately larger size in relative terms.

BRIEF DESCRIPTION OF THE DRAWINGS

In the following, the invention is explained by embodiments of the invention, making reference to the accompanying drawings.

DETAILED DESCRIPTION

Figure 11:
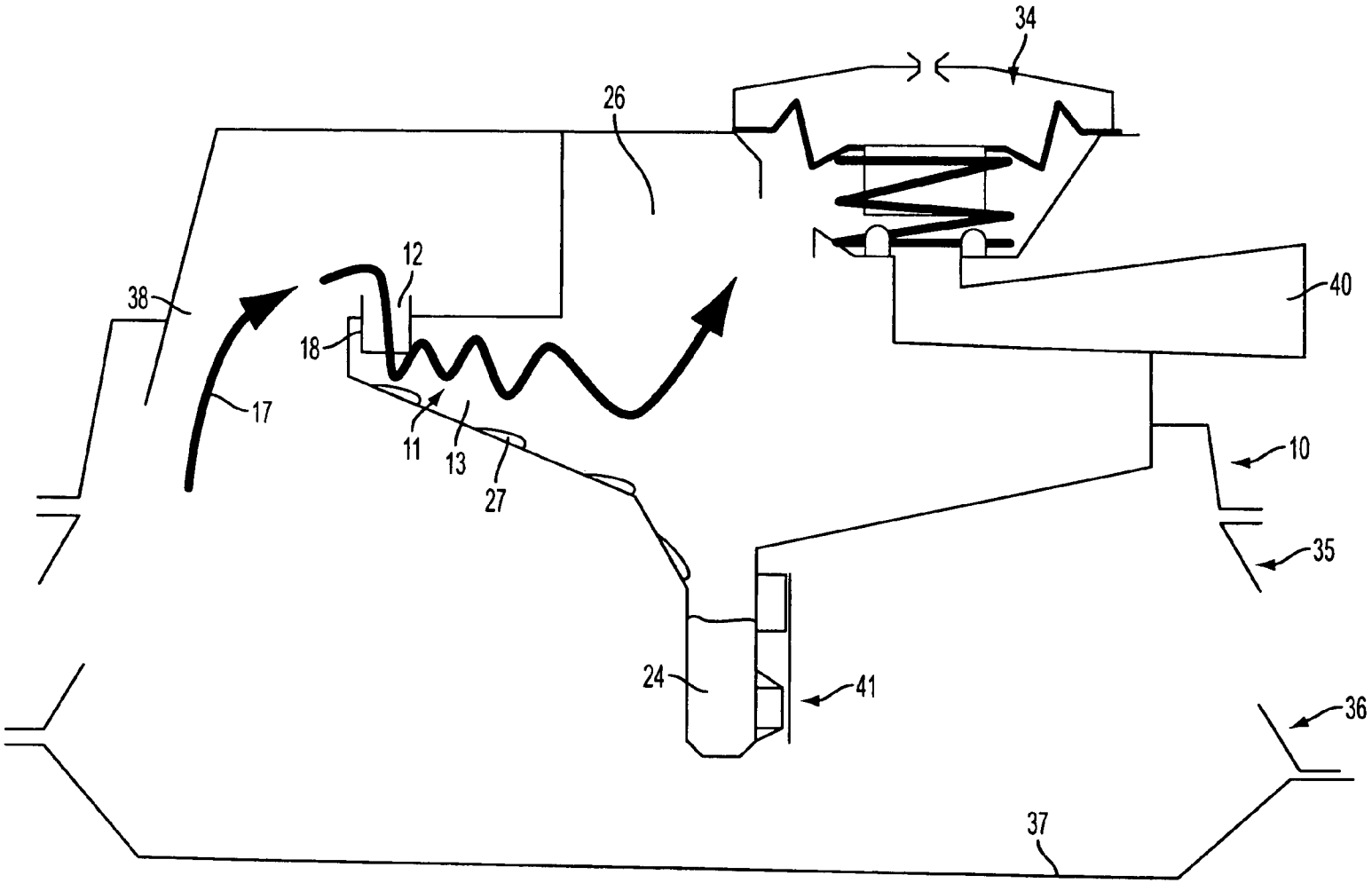
FIG. 11 depicts a cross section through an internal combustion engine.

The internal combustion engine shown in FIG. 11 comprises the cylinder head cover 10, the cylinder head 35, the crankcase 36 and the oil pan 37. The cylinder head cover 10 comprises a gas inlet region 38 for oil-laden blow-by gas 17, an oil separator 11 through which the introduced blow-by gas 17 flows with a vortex chamber 13, an adjacent clean chamber 26 with oil drain 24, a pressure control valve 34 and a gas outlet region 40. The blow-by gas is directed from the crankcase 36 into the cylinder head cover 10 for example via channels provided in the engine housing which are not shown. The oil separator 11 has an inlet opening 12 through which the oil-laden blow-by gas 17 tangentially enters a pipe-shaped chamber 13.

Figure 1:
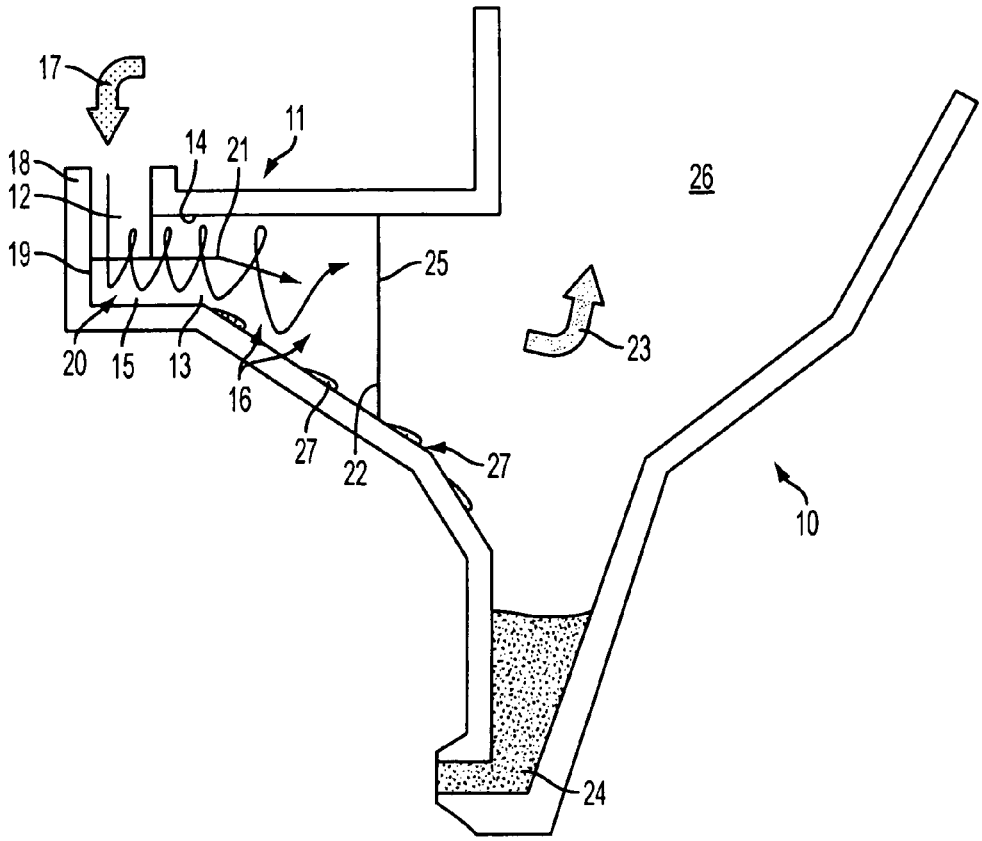
FIG. 1 depicts a cross section through an oil separator.

As is shown in FIG. 1 the chamber 13 is formed by a pipe-shaped circumferential wall 14. In the circumferential wall 14 a gas inlet opening 12 is provided at a proximal end of the vortex chamber 13. Around the gas inlet opening 12 a pipe-shaped gas inlet 18 is provided which is arranged tangentially to the vortex chamber 13. The pipe-shaped gas inlet 18 creates a tangentially directed flow of the blow-by gas entering the chamber 13 through the gas inlet opening 12. The gas flow entering through the gas inlet opening 12 is directed along the chamber wall 14. Because of the flow component in the longitudinal direction 21*a* helical gas vortex 20 rotating about the longitudinal axis is created in the chamber 13, without additional guiding devices such as for example guide plates or the like being required. "Helical" means that the gas vortex in a mean load range of the engine performs at least one complete revolution, preferably at least two complete revolutions. The rotating gas vortex 20 spreads in a longitudinal direction 21 of the pipe-shaped chamber 13. The longitudinal direction 21 runs along the centre axis of the chamber 13 and can therefore be joined together by segments, as is evident for example from FIG. 1.

The centrifugal forces acting on the oil particles in the gas vortex 20 bring about a separation of the oil particles through contact with the circumferential wall 14 and coalescence of the oil particles accumulating in the outer region of the chamber 13 into oil droplets. The separated oil drains along the circumferential wall 14 of the chamber 13 and is returned to the engine oil circuit by means of a return 24. In order to ensure the gravity discharge of the oil without stagnant spaces the floor of the chamber 13 in the operating position preferably has a steady downward gradient as far as to the oil discharge 24. Through a non-return valve 41 shown for example in FIG. 11 the entry of blow-by gas into the clean chamber 26 through the oil drain line 24 in reverse direction is prevented.

The characteristic of the efficiency or the pressure loss of the vortex chamber separator 11 as a function of the flow rate corresponds approximately to the characteristic of a cyclone with immersion tube.

Having passed through the chamber 13 the helical gas vortex 20 runs out at the distal end 22 of the chamber 13, i.e. it turns into a non-rotating flow and exits the chamber 13 through the gas outlet opening 25 arranged at the distal end 22 end of the vortex chamber 13. The cleaned blow-by gas 23 is then directed through a clean chamber 26 for example to the pressure control valve 34 (see FIG. 11).

Because the gas outlet is arranged at the distal end 22 of the vortex chamber 13, an open design of the chamber 13 is obtained. In particular an injection mould used in the manufacture of the oil separator 11 can engage in the chamber 13 through the gas outlet opening 25. For this purpose it is advantageous if, as in the examples of FIGS. 1, 4 to 7 and 10, the cross section of the chamber 13 has no constriction between the end near the inlet 19 and the opposing end 22 and that the area of the gas outlet opening 25 preferably is greater or equal to the maximum cross sectional area of the chamber 13.

The open design of the vortex chamber 13 allows to drain the separated oil 27 from the vortex chamber 13 through the gas outlet opening 25 having a large cross section (see exemplary embodiments according to FIGS. 1, 4 to 6 and 10). In this way, the oil discharge with low cross section present in the prior art which shows unfavourable freezing characteristic can be avoided. In other words the oil discharge 24 preferably leads into the clean chamber 26 and not into the vortex chamber 13 as in the prior art.

As is evident from FIG. 1 no flow reversal of the gas in the opposite direction takes place at the distal end of the vortex chamber 13 in pronounced distinction from a conventional cyclone with immersion tube.

As shown in FIG. 1, the chamber 13 in particular in the gas inlet region preferably comprises a substantially cylindrical section 15 so that a stable gas vortex 20 is able to form, with a preferred axial length of at least 0.5 times the diameter, more preferably in the range of 0.5 to 5-times and more preferably 1 to 3 times the diameter. "substantially cylindrical" encompasses a conicity of some degrees, i.e. up to 10°, owing to an extraction draft due to the manufacture.

Figure 2A:
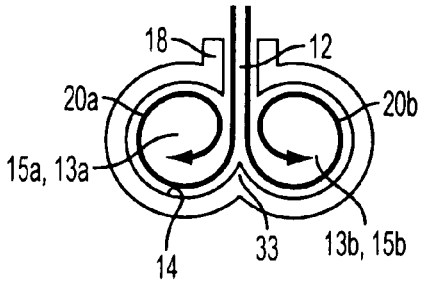
FIG. 2*a* depicts a cross section through an oil separator in the region of the gas inlet.
Figure 2B:
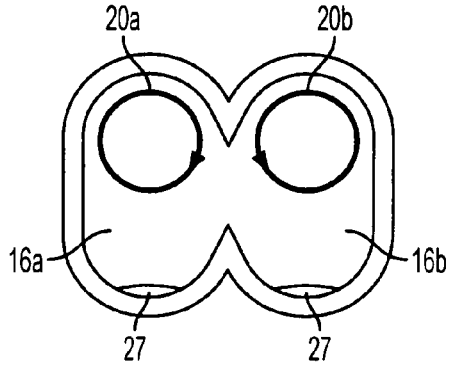
FIG. 2*b* depicts a cross section through an oil separator in the region of the diffuser.

As is shown in FIGS. 1 and 2*b* the chamber 13 in particular in the distal end region preferably comprises a section 16 widening in longitudinal direction 21 for the formation of a diffuser in which the rotating velocity of the gas is reduced and as a result the probability that the draining liquid is again picked up by the gas vortex is reduced. At the same time, the pressure loss is reduced via the separator 11. With a view to the desired effect the conicity of the diffuser 16 preferably amounts to at least 10°, further preferably at least 20°, yet further preferably at least 30°.

Figure 8A:
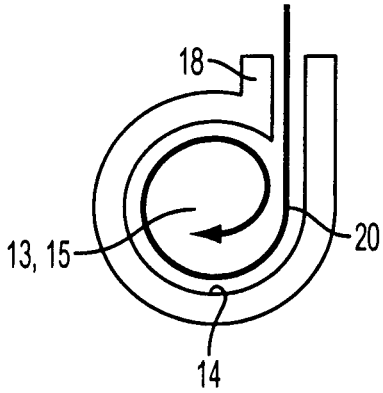
FIGS. 8*a*, 8*b* depict cross sections through an oil separator in the region of the gas inlet or the diffuser in a further embodiment.
Figure 8B:
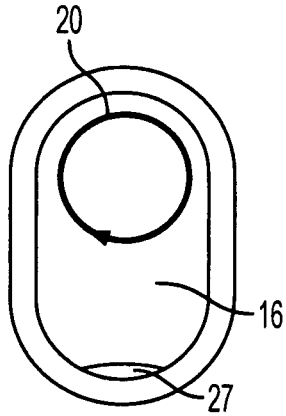

With the formation of the diffuser 16 oval in cross section as shown in the FIGS. 1, 2*b* and 8*b*, the gas vortex 20 initially separates from the lower rim of the chamber 13 so that the draining liquid 27 no longer has any gas contact there and thus cannot be picked up by the gas flow again. For this purpose it is advantageous if the chamber 13 in the lower region widens more intensively than in the upper region, in particular if the chamber 13 widens merely downwards, but not in the upper region, as is the case for example in FIG. 1.

In the preferred embodiment according to FIGS. 2*a*, 2*b* the vortex chamber 13 has two sub-chambers 13*a*, 13*b* which are preferably arranged in parallel and contact each other tangentially with a jointly utilized gas inlet 18 for the formation of two gas vortices 20*a*, 20*b* rotating in opposite directions and arranged in parallel; this is thus a dual chamber. The gas inlet 18 is preferably tangentially directed in the region of the tangential contact of the two sub-chambers 13*a*, 13*b* and further preferably to the centre of a land 33 which serves as flow divider. The sub-chambers 13*a*, 13*b* are preferably located (mirror) symmetrically to the gas inlet 18. The circumferential wall 14 of the chamber 13 is therefore preferably designed omega shaped or ω-shaped, as shown in FIG. 2*a*. Compared with a separator with only one gas vortex the flow rate of the separator can be substantially doubled with a relatively slightly larger size. However, the invention is not restricted to a defined number of gas vortices. It encompasses in particular embodiments with one gas vortex, as with the chamber 13 shown in FIGS. 8*a*, 8*b*. Embodiments with more than two parallel gas vortices are also conceivable.

Figure 3:
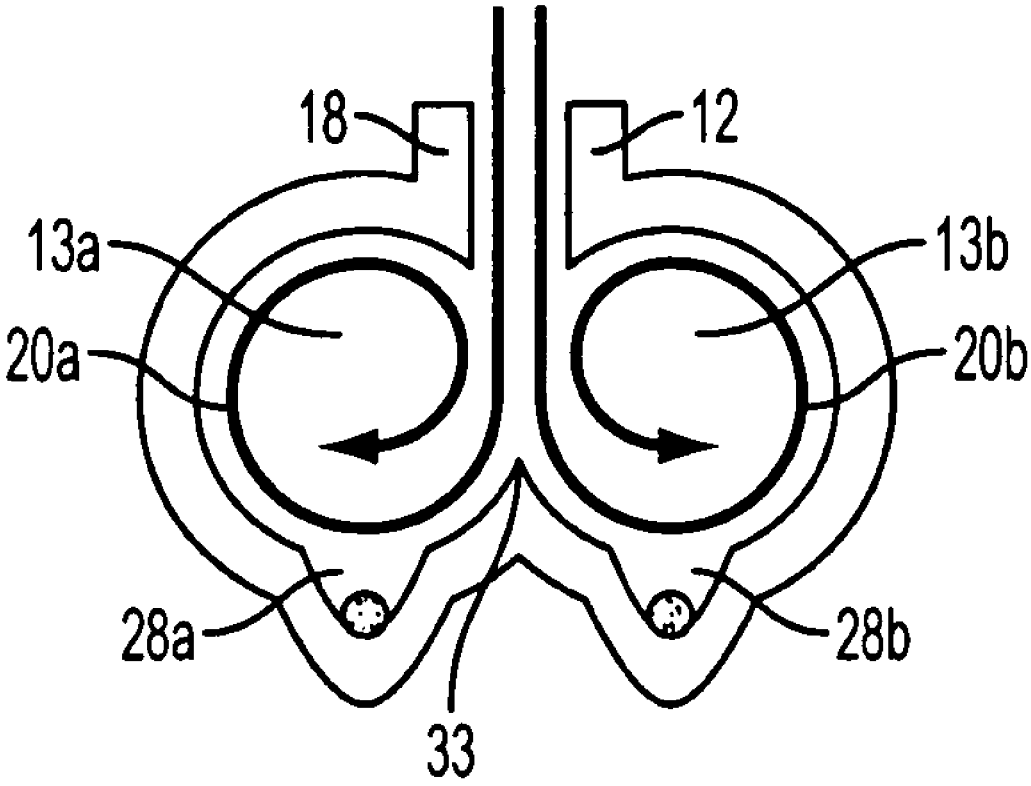
FIG. 3 depicts a cross section through an oil separator in the region of the gas inlet in a further embodiment.
Figure 9:
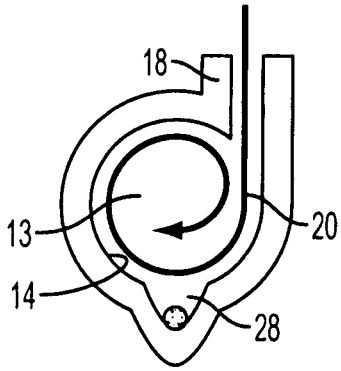
FIG. 9 depicts a cross section through an oil separator in the region of the gas inlet in a further embodiment.

In order to stop the gas contact with the draining oil 27 at as early a stage as possible, a drain slot 28 or, in the case of several sub-chambers 13*a*, 13*b*, one or several drain slots 28*a*, 28*b* can be provided in the circumferential wall 14 in an embodiment according to FIG. 3 or 9 in the lower part of the chamber 13 or the diffuser 16, which are arranged below the circumference defined by the circumferential wall 14.

Figure 4:
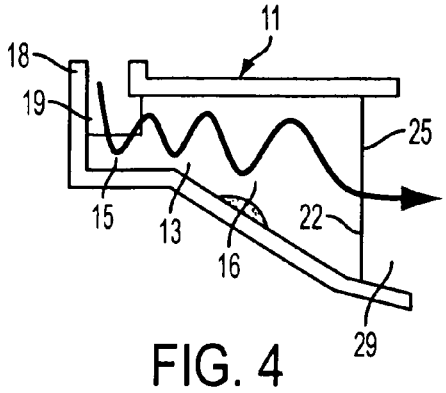
FIGS. 4-7 depict longitudinal sections through an oil separator in further embodiments.
Figure 5:
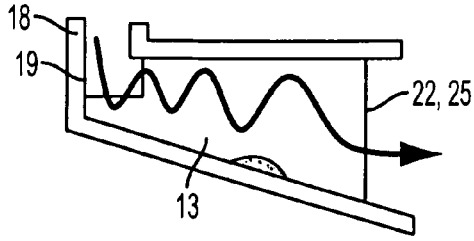
Figure 6:
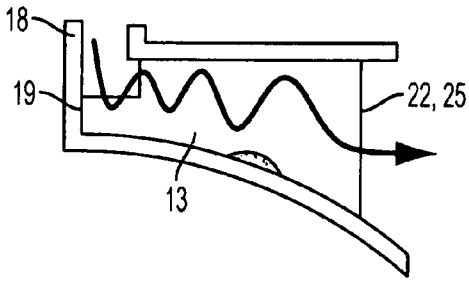

The embodiments shown in the FIGS. 4 to 6 make clear that the formation of the vortex chamber 13 in longitudinal direction is variable in a variety of manners. In the example of FIG. 4 a more or less intensively widening region 29 follows the diffuser 16. In the example of FIG. 5 the entire vortex chamber 13 widens uniformly. In the example of FIG. 6 the vortex chamber 13 widens with steadily increasing downward gradient in the gas outlet direction.

Figure 7:
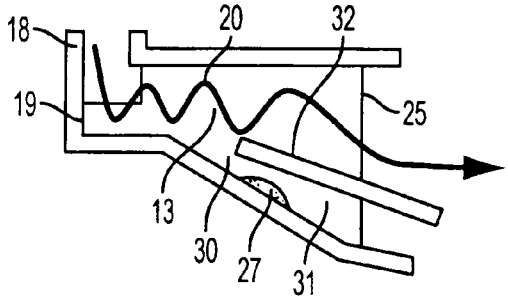

In the exemplary embodiment shown in FIG. 7 an oil drain opening 30 to an oil drain channel 31 is present in the floor of the chamber 13. Through the separation of gas vortex 20 and draining oil 27 by means of the separating wall 32 re-absorption of separated oil 27 by the gas vortex 20 is effectively stopped.

Figure 10:
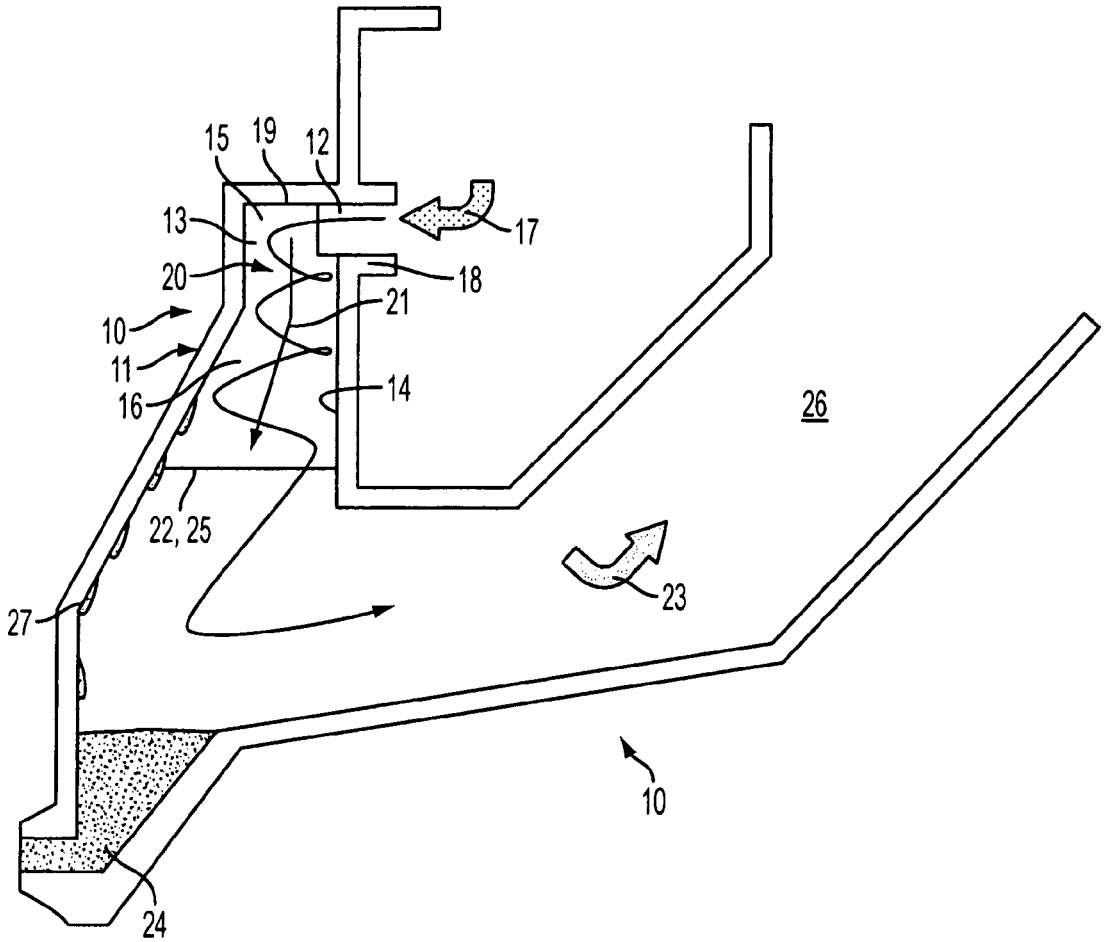
FIG. 10 depicts a cross section through an oil separator in a further embodiment.

The embodiment according to FIG. 10 relates to a vertically arranged vortex chamber 13 in contrast with the—preferred with regard to a reduced height—substantially horizontal installation position in the examples of FIGS. 1 and 4 to 7. Since emulsion incurred in the vertical arrangement according to FIG. 10 is able to drain off better this is preferred with regard to the freezing characteristics.

Depending on the application separators with inclined installation position of the vortex chamber 13 are also possible.

What is claimed is:

1. A cylinder head cover for an internal combustion engine, comprising:

an oil separator with a vortex chamber extending in a longitudinal direction from a proximal end to a distal end, said vortex chamber comprising:

a plurality of parallel sub-chambers each comprising an essentially pipe-shaped wall extending in said longitudinal direction, a gas inlet common to said sub-chambers arranged at said proximal end of said vortex chamber and oriented tangentially to each of said essentially pipe-shaped walls, for tangentially blowing blow-by gas into said sub-chambers, such that a gas vortex flow helically rotating along said essentially pipe-shaped wall in the longitudinal direction from said proximal end to said distal end of said vortex chamber is created in each of said sub-chambers, and at least one gas outlet opening, wherein said gas outlet opening is arranged in the region of said distal end of said vortex chamber.

2. The cylinder head cover according to claim 1, wherein said vortex chamber is omega-shaped in a cross section through said common gas inlet.

3. The cylinder head cover according to claim 1, wherein said gas inlet is valve-free.

4. The cylinder head cover according to claim 1, wherein said vortex chamber has a segment which widens in a direction towards said distal end of said vortex chamber.

5. The cylinder head cover according to claim 1, wherein said vortex chamber has a segment with a substantially constant cross-section.

6. The cylinder head cover according to claim 5, wherein said segment with substantially constant cross-section has a length in the range of 0.5 to 5-times, preferably 1 to 3-times its average diameter.

7. The cylinder head cover according to claim 1, wherein said gas outlet opening has an area which is greater or equal to the maximum cross sectional area of said vortex chamber.

8. The cylinder head cover according to claim 1, wherein said gas outlet opening is adapted to discharge oil from said vortex chamber.

9. The cylinder head cover according to claim 1, wherein said pipe-shaped walls of said sub-chambers comprise at least one longitudinal groove for draining off oil.

* * * * *